US007244400B2

(12) United States Patent
Darling

(10) Patent No.: US 7,244,400 B2
(45) Date of Patent: Jul. 17, 2007

(54) FLUIDIZED BED REACTOR SYSTEM HAVING AN EXHAUST GAS PLENUM

(75) Inventor: Scott Darling, Annandale, NJ (US)

(73) Assignee: Foster Wheeler Energy Corporation, Clinton, NJ (US)

( * ) Notice: Subject to any disclaimer, the term of this patent is extended or adjusted under 35 U.S.C. 154(b) by 477 days.

(21) Appl. No.: 10/720,218

(22) Filed: Nov. 25, 2003

(65) Prior Publication Data

US 2005/0112037 A1 May 26, 2005

(51) Int. Cl.
*B01J 8/18* (2006.01)

(52) U.S. Cl. ..... 422/147; 422/139; 422/145; 422/146; 122/6 A

(58) Field of Classification Search ..... None
See application file for complete search history.

(56) References Cited

U.S. PATENT DOCUMENTS

| | | | | | |
|---|---|---|---|---|---|
| 4,355,602 | A | * | 10/1982 | Cooke | 122/235.11 |
| 4,665,865 | A | | 5/1987 | Zubrod | 122/235 A |
| 5,050,542 | A | * | 9/1991 | Cooke | 122/235.23 |
| 5,103,773 | A | | 4/1992 | Andersson et al. | 122/4 D |
| 5,281,398 | A | * | 1/1994 | Hyppanen et al. | 422/147 |
| 5,772,969 | A | | 6/1998 | Hyppanen | 422/146 |
| 5,870,976 | A | * | 2/1999 | Cooke | 122/347 |

FOREIGN PATENT DOCUMENTS

WO WO 95/0033159 12/1995

OTHER PUBLICATIONS

Reh, Lothar, Prof. Dr.-Ing., et al. "Development Potentials of Circulating Fluidized Bed Combustion," The Future of Fluidized Bed Combustion, *VGB Technical Scientific Reports "Thermal Power Plants."* Published by VGB Technische Vereinigung Der Grosskraftwerksbetrelber E.V. (1998) pp. 1-31.

Riley, Kevin, P.E., et al. "Large CFB Power Plant Design and Operating Experience, Texas-New Mexico Power Company, 150 MWe (NET) CFB Power Plant," $13^{13}$ International Conference on Fludized Bed Combustion, V. 2, 1995. pp. 1501-1505.

Gottung, E.J., et al. "Design Considerations For Circulating Fluidized Bed Steam Generators," 1989 International Conference on Fluidized Bed Combustion, V. 1, 1989, pp. 617-623.

* cited by examiner

*Primary Examiner*—Glenn Caldarola
*Assistant Examiner*—Jennifer A. Leung
(74) *Attorney, Agent, or Firm*—Fitzpatrick, Cella, Harper & Scinto

(57) ABSTRACT

An arrangement for directing exhaust gases from at least one particle separator of a circulating fluidized bed reactor system to a heat recovery section includes a gas plenum located above a reaction chamber, the gas plenum being defined by a ceiling, a bottom, and walls and being integrated with the reaction chamber. The walls of the gas plenum are provided with at least one inlet opening for cleaned exhaust gases, each of which is coupled with a discharge duct connected to one of the particle separators, for directing the cleaned exhaust gases from the particle separators to the gas plenum, from where the cleaned exhaust gases are directed to the heat recovery section downstream of the gas plenum. The reaction chamber is at least partially formed by water tube panels, and the enclosure of the gas plenum is also formed by water tube panels as extensions of water tube panels of the reaction chamber.

7 Claims, 9 Drawing Sheets

FLUIDIZED BED REACTOR SYSTEM HAVING AN EXHAUST GAS PLENUM

BACKGROUND OF THE INVENTION

1. Field of the Invention

This invention relates to an arrangement in a circulating fluidized bed reactor system for directing exhaust gases from at least one particle separator to a heat recovery section.

2. Description of the Related Art

The circulating fluidized bed reactor system comprises a reaction chamber, having a fluidized bed of solid particles therein and a particle suspension of exhaust gases and solid particles being discharged through at least one discharge opening arranged in the upper part thereof. Each discharge opening is connected to a particle separator for separating the solid particles from the particle suspension. The upper part of each particle separator is provided with a gas discharge opening for the discharge of cleaned exhaust gas flow. The cleaned exhaust gases are directed from the particle separators to a heat recovery section of the circulating fluidized bed reactor system. Each particle separator is connected from its lower part to a return duct, which again is connected to the reaction chamber, for circulating the solid particles separated in the particle separator back to the lower part of the reaction chamber. It is also possible to connect a heat exchanger to the lower part of the return duct for recovering heat from the circulating solid particles.

According to a generally-used manner, the exhaust gases of the particle separators are directed along refractory-lined ductwork to a heat recovery section of the circulating fluidized bed reactor system. This kind of arrangement is disclosed, for example, in the presentation "Development Potentials of Circulating Fluidized Bed Combustion" in VGB report "Thermal Power Plants: The Future of Fluidized Bed Combustion" (1998).

A disadvantage in this kind of arrangement is that erosion and temperature fluctuations cause wearing and embrittlement in the refractory-lined ducts, whereby the ducts require regular maintenance. Furthermore, refractory-lined ducts are heavy and require additional support. Since the ducts have no heat surfaces, it is not possible to recover heat energy from the exhaust gases therein.

The presentation "Large CFB Boiler Plant Design and Operating Experience Texas-New Mexico Power Company 150 MWe (net) CFB Power Plant" published in ASME-conference publication 1995, vol. 2, "Fluidized Bed Combustion," discloses another arrangement for directing exhaust gases from particle separators to the heat recovery section of a circulating fluidized bed reactor system. The exhaust gases flowing through the gas discharge openings of the particle separators are first directed through discharge ducts to a horizontal extension of the heat recovery section, which is bent above the reaction chamber of the circulating fluidized bed reactor. From there, the exhaust gases are further directed to a vertical part of the heat recovery section.

A significant disadvantage in such a circulating fluidized bed reactor system is that it is difficult to extend vertically running tubes of the vertical part of the heat recovery section to the horizontal part of the heat recovery section. Another disadvantage is the need for a complicated support of the horizontal extension of the heat recovery section and of the reaction chamber.

The presentation "Design Considerations for Circulating Fluidized Bed Steam Generators" published in ASME conference publication 1989, "1989 International Conference on Fluidized Bed Combustion," discloses an arrangement for directing exhaust gases from two particle separators to the heat recovery section of a circulating fluidized bed reactor system, in which arrangement a gas plenum is positioned above and integrated with a reaction chamber for directing exhaust gases from particle separators to the heat recovery section. Side walls of the gas plenum are formed by water tube panels of walls of the reaction chamber, but the bottom and ceiling of the gas plenum are formed as extensions of water tube panels of the backpass. Such a construction is complicated and may cause stresses due to different thermal expansions.

SUMMARY OF THE INVENTION

One purpose of the invention is to provide a new arrangement for directing exhaust gases from at least one particle separator to a heat recovery section, in which the above-mentioned problems of the prior art have been minimized.

Another purpose of the invention is to provide a new arrangement for directing exhaust gases from at least one particle separator to a heat recovery section, wherein refractory-lined ducts are not necessary.

It is especially a purpose of the invention to provide an arrangement for directing exhaust gases from at least one particle separator to a heat recovery section, the arrangement forming a compact structure that does not need additional support.

Furthermore, it is a purpose of the invention to provide a new arrangement for directing exhaust gases from at least one particle separator to a heat recovery section, the arrangement enabling formation of a portion of a circulating fluidized bed reactor system between at least one particle separator and the heat recovery section, and the formation being accomplished by using water tube panels in a very simple and feasible manner.

To solve the above-described problems and to achieve the above-described objects, an arrangement in accordance with the invention for directing exhaust gases from at least one particle separator to a heat recovery section is provided.

The arrangement in accordance with the invention relates to a circulating fluidized bed reactor system, including a reaction chamber, having a fluidized bed of solid particles therein, and being defined by a ceiling, a bottom, and walls, which are at least partially formed by water tube panels; means for introducing fluidizing gas into the reaction chamber; at least one discharge opening arranged in the walls of the reaction chamber for removing a particle suspension of exhaust gases and solid particles from the reaction chamber; at least one particle separator connected to the discharge openings, for separating the solid particles from the particle suspension, each of the particle separators having a gas discharge opening in an upper part thereof, for discharge of cleaned exhaust gases, each of the gas discharge openings being connected to a discharge duct; a heat recovery section, to which the cleaned exhaust gases are directed and a gas plenum, defined by an enclosure comprising a ceiling, a bottom, and walls, positioned above and integrated with the reaction chamber, for directing the cleaned exhaust gases discharged from the at least one particle separator to the heat recovery section, the gas plenum being provided with at least one exhaust gas inlet opening arranged in the walls thereof for receiving the cleaned exhaust gases from the discharge duct of the at least one particle separator and directing the cleaned exhaust gases to the gas plenum, the gas plenum also being connected to a connecting channel downstream of the gas plenum for leading the cleaned exhaust gases from the gas plenum to the heat recovery section.

A characteristic feature of the invention is that the enclosure of the gas plenum is formed by water tube panels as extensions of the water tube panels of the reaction chamber.

In a preferred embodiment of the invention, at least a portion of the bottom and of the walls of the enclosure of the gas plenum is advantageously formed in such a way that an extension of the water tube panel that forms a first one of the reaction chamber walls is (i) bent at the upper edge of the first reaction chamber wall and extended toward an opposite, second wall of the reaction chamber, (ii) bent 180 degrees and extended to the lower edge of one of the gas plenum walls that is directly above the first reaction chamber wall, and (iii) bent upward and extended to the upper edge of the gas plenum wall that is directly above the first reaction chamber wall.

In another preferred embodiment of the invention, at least a portion of the bottom and of the walls of the enclosure of the gas plenum is advantageously formed in such a way that extensions of the water tube panels that form two opposite walls of the reaction chamber are (i) bent toward each other at the respective upper edges of the reaction chamber walls and extended in such a way that the extensions meet each other, (ii) bent 180 degrees and extended to the lower edges of respective opposite walls of the gas plenum that are directly above the two opposite reaction chamber walls, and (iii) bent upward and extended to the upper edges of the respective opposite gas plenum walls.

In a third preferred embodiment of the invention, at least a portion of the bottom and of the walls of the enclosure of the gas plenum is advantageously formed in such a way that an extension of the water tube panel that forms a first one of the reaction chamber walls is (i) bent at the upper edge of the first reaction chamber wall and extended toward an opposite, second wall of the reaction chamber, and (ii) bent upward and extended to the upper edge of one of the gas plenum walls that is directly above the second reaction chamber wall.

In a fourth preferred embodiment of the invention, the water tube panel of a first one of the walls of the reaction chamber comprises first and second water tubes, at least a portion of the water tube panel that forms the gas plenum bottom is advantageously formed as an extension of the first water tubes of the water tube panel that forms the first wall of the reaction chamber, and at least a portion of the water tube panel that forms one of the gas plenum walls is advantageously formed as an extension of the second water tubes of the water tube panel that forms the first wall of the reaction chamber.

In a fifth preferred embodiment of the invention, the gas plenum is divided into at least two separate chambers by at least one partition that is formed by at least one water tube panel as an extension of at least one of the water tube panels of the reaction chamber.

In a sixth preferred embodiment of the invention, the gas plenum is divided into at least two separate chambers by at least one partition that is formed by at least one water tube panel as an extension of at least one of the water tube panels of the reaction chamber, and the water tube panel that forms a first one of the walls of the reaction chamber comprises first and second water tubes, at least a portion of the water tube panel that forms the bottom of the enclosure of the gas plenum is advantageously formed as an extension of the first water tubes of the water tube panel that forms the first wall of the reaction chamber, at least a portion of the water tube panel that forms one of the walls of the enclosure of the gas plenum is advantageously formed as an extension of the second water tubes of the water tube panel that forms the first wall of the reaction chamber, and at least a portion of the water tube panel that forms the partition of the gas plenum is formed as an extension of the first water tubes of the water tube panel that forms the first wall of the reaction chamber.

In a seventh preferred embodiment of the invention, the gas plenum is divided into at least two separate chambers by at least one partition that is formed by at least one water tube panel as an extension of at least one of the water tube panels of the reaction chamber, and the water tube panel that forms a first one of the walls of the reaction chamber comprises first and second water tubes, at least a portion of the water tube panel that forms the bottom of the enclosure of the gas plenum is advantageously formed as an extension of the first water tubes of the water tube panel that forms the first wall of the reaction chamber, at least a portion of the water tube panel that forms one of the walls of the enclosure of the gas plenum is advantageously formed as an extension of the first water tubes of the water tube panel that forms the first wall of the reaction chamber, and at least a portion of the water tube panel that forms the partition of the gas plenum is formed as an extension of the second water tubes of the water tube panel that forms the first wall of the reaction chamber.

In an arrangement in accordance with the invention, the enclosure of the gas plenum may be at least partially formed as an extension of the water tube panel that forms one of the reaction chamber walls in such a way that a portion of the water tubes of the water tube panel that forms the reaction chamber wall is connected at the upper edge of the reaction chamber wall to a header, from which header the water tubes are extended to form a portion of the enclosure of the gas plenum.

In an arrangement in accordance with the invention having at least three particle separators, the discharge duct of at least one of the particle separators may advantageously be connected directly to the connecting channel downstream of the gas plenum. The connecting channel may advantageously widen in the flow direction of the cleaned exhaust gases.

By utilizing an arrangement in accordance with the invention, the use of refractory-lined ducts and the problems associated with ducts, such as a need for maintenance due to embrittlement and wearing of the ducts, are minimized.

Since the portion of the reactor system between the particle separators and the heat recovery section, i.e., the gas plenum, is integrated with the reaction chamber, no additional supports are necessary in the arrangement.

Since the gas plenum is integrated with the reaction chamber, it may be formed in a simple and easy manner as an extension of the water tube panels of the reaction chamber walls.

In an arrangement in accordance with the invention, the gas plenum may be provided with one chamber or it may be multi-chambered. Usually, the gas plenum is rectangular, but in special cases the gas plenum may have a different horizontal cross section, such as a hexagonal or octagonal cross section.

An arrangement for directing exhaust gases from a plurality of particle separators of a circulating fluidized bed reactor system to a heat recovery section in accordance with a preferred embodiment of the invention is described below, and thereafter, different preferred embodiments for forming the gas plenum of the arrangement in accordance with the invention by water tube panels as extensions of water tube panels of the reaction chamber walls are described. The description refers to the accompanying drawings.

DETAILED DESCRIPTION OF THE PREFERRED EMBODIMENTS

Figure 1:
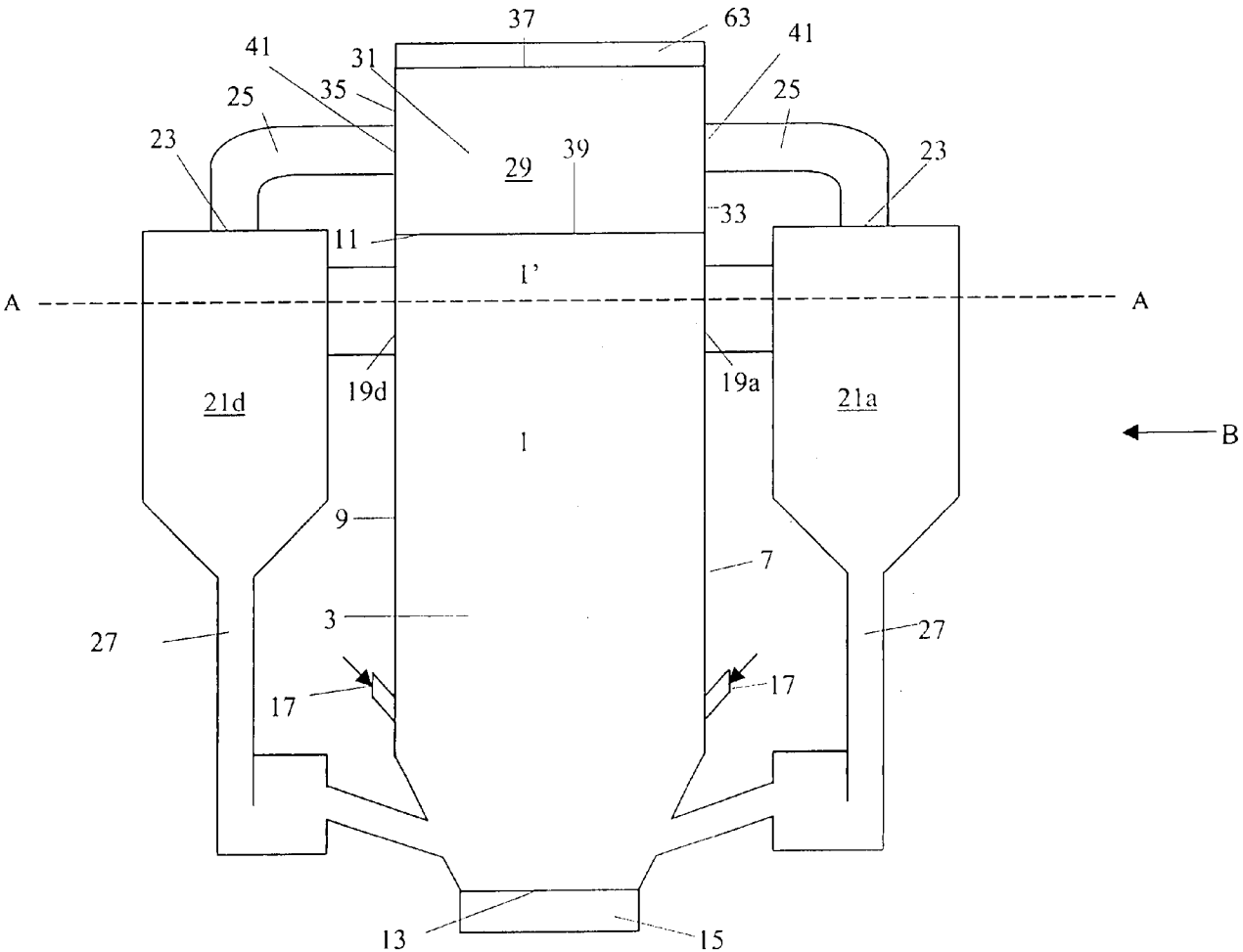
FIG. 1 is a schematic front view of an arrangement for directing exhaust gases from a plurality of particle separators of a circulating fluidized bed reactor system to a heat recovery section in accordance with the invention.
Figure 2:
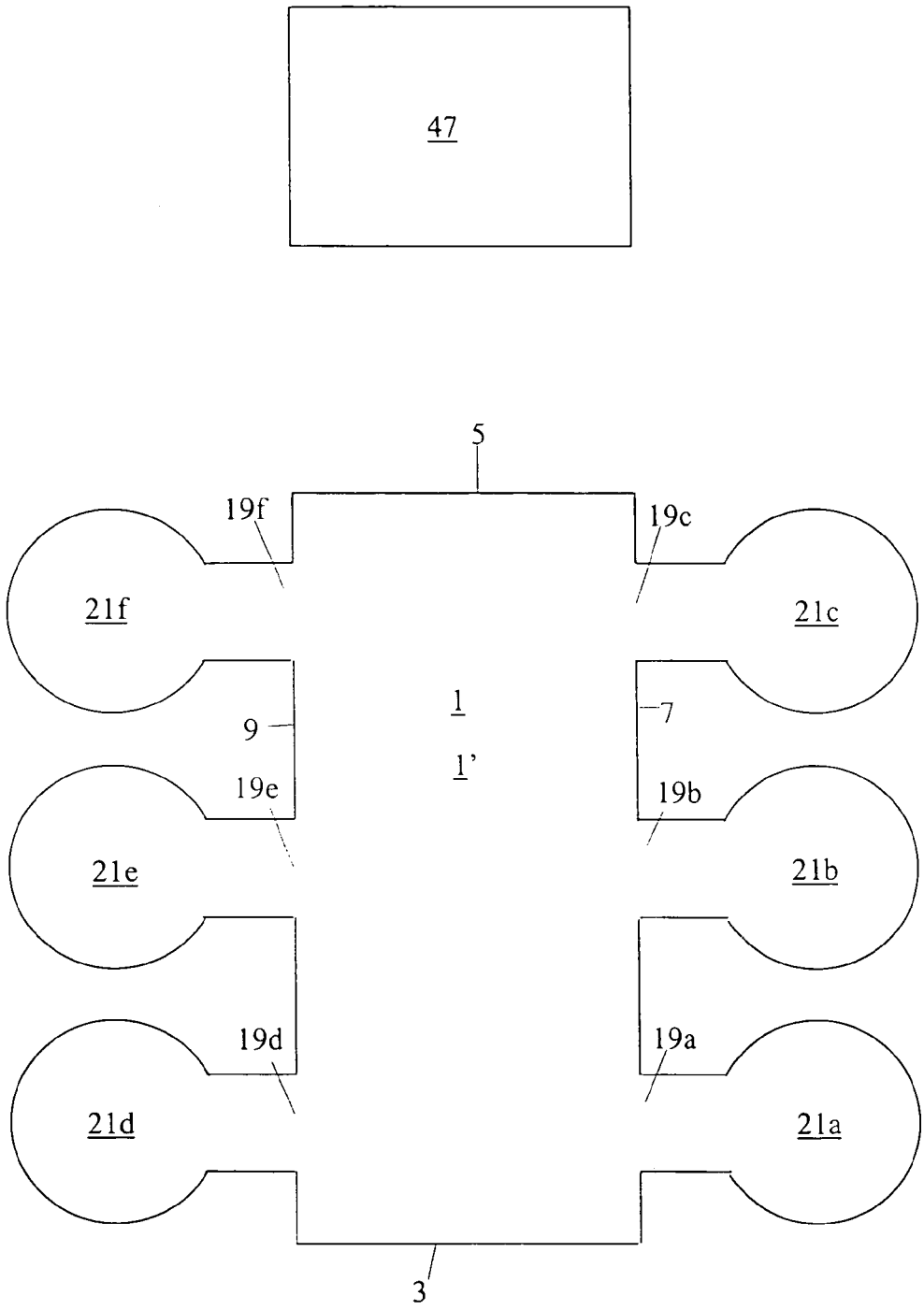
FIG. 2 is a schematic cross-sectional view along a horizontal plane A—A of the arrangement of FIG. 1.
Figure 3:
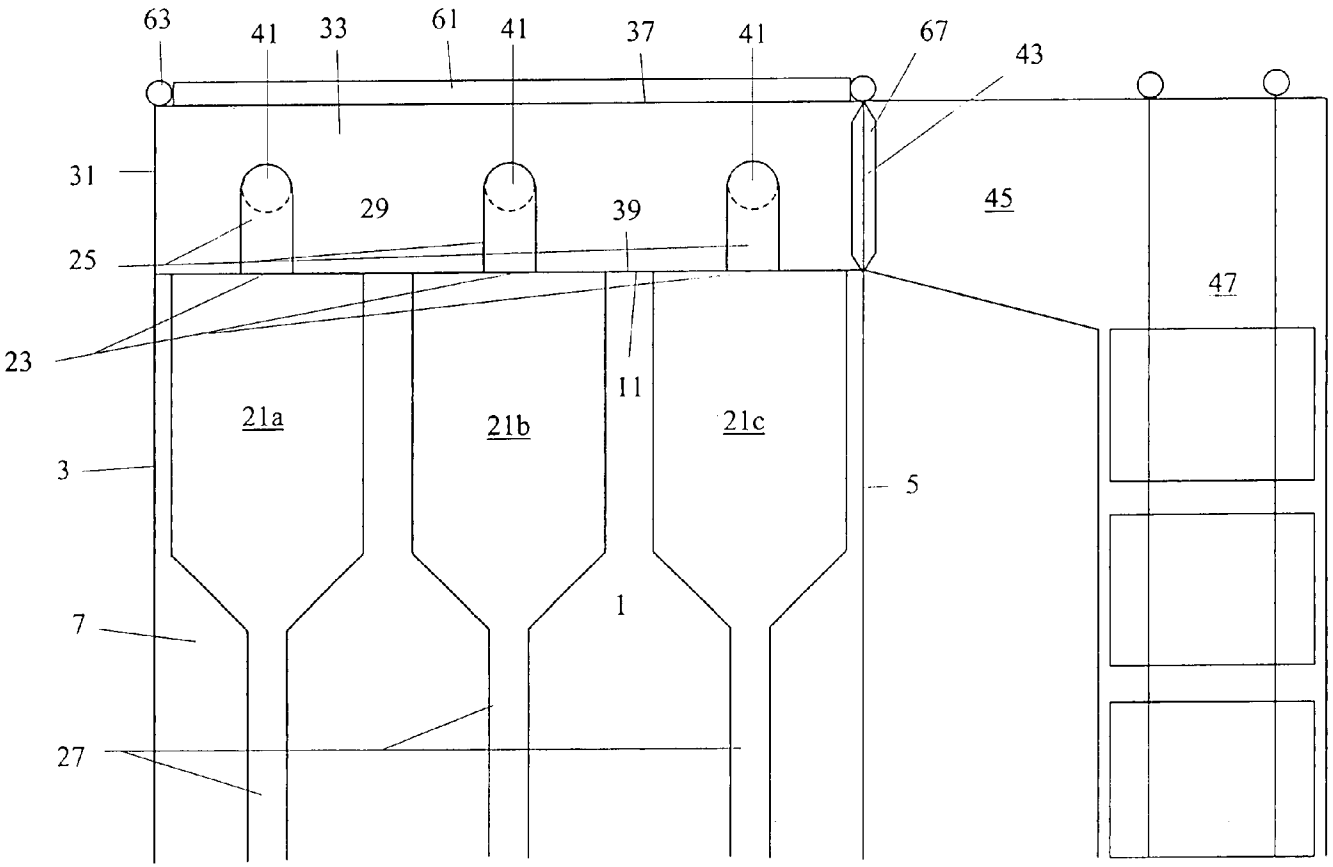
FIG. 3 is a schematic, partly cross-sectional side view of the arrangement of FIG. 1, seen in the direction of arrow B.

A circulating fluidized bed reactor system, as shown in FIGS. 1, 2, and 3, comprises a reaction chamber 1, having a fluidized bed of solid particles therein. The reaction chamber 1 is defined by a front wall 3, a rear wall 5, a right side wall 7 and a left side wall 9, a ceiling 11, and a bottom 13, of which chamber is formed by conventional water tube panels comprising water tubes joined by fins. The reaction chamber 1 comprises means 15 for introducing fluidizing gas, such as nozzles or airpipes, and means 17 for introducing fuel, such as pneumatic or gravimetric fuel feeders. The side walls 7, 9 of the reaction chamber are provided with six discharge openings 19*a*–19*f* for removing a particle suspension of exhaust gas and solid particles, formed in the reaction chamber 1, through an upper part 1' of the reaction chamber 1. The discharge openings 19*a*–19*f* of the reaction chamber are respectively provided with six particle separators 21*a*–21*f* for separating the solid particles from the particle suspension removed from the reaction chamber 1. Each particle separator 21 has in its upper part a gas discharge opening 23 for removing cleaned exhaust gas from the particle separator. Each gas discharge opening 23 is connected to a discharge duct 25. Each particle separator 21 is also connected to a return duct 27, through which the separated solid particles are recirculated from the particle separator to the lower part of the reaction chamber 1.

A gas plenum 29 is located above and integrated with the reaction chamber 1. The gas plenum 29 is defined by a front wall 31, a rear wall 43, a right side wall 33, a left side wall 35, a ceiling 37, and a bottom 39. The side walls 33, 35 of the gas plenum are provided with six inlet openings 41 for the cleaned exhaust gas, each inlet opening 41 being connected to one of the discharge ducts 25 for directing the cleaned exhaust gases exiting from one of the particle separators 21 to the gas plenum 29. The cleaned exhaust gases are directed through the rear wall 43 of the gas plenum via a connecting channel 45 to a heat recovery section 47. In the embodiment of FIGS. 1, 2, and 3, the gas plenum 29 may have either one chamber or two chambers.

According to the invention, the gas plenum 29 is formed by water tube panels as extensions of the water tube panels of the walls 3, 7, 9 of the reaction chamber 1.

Figure 4:
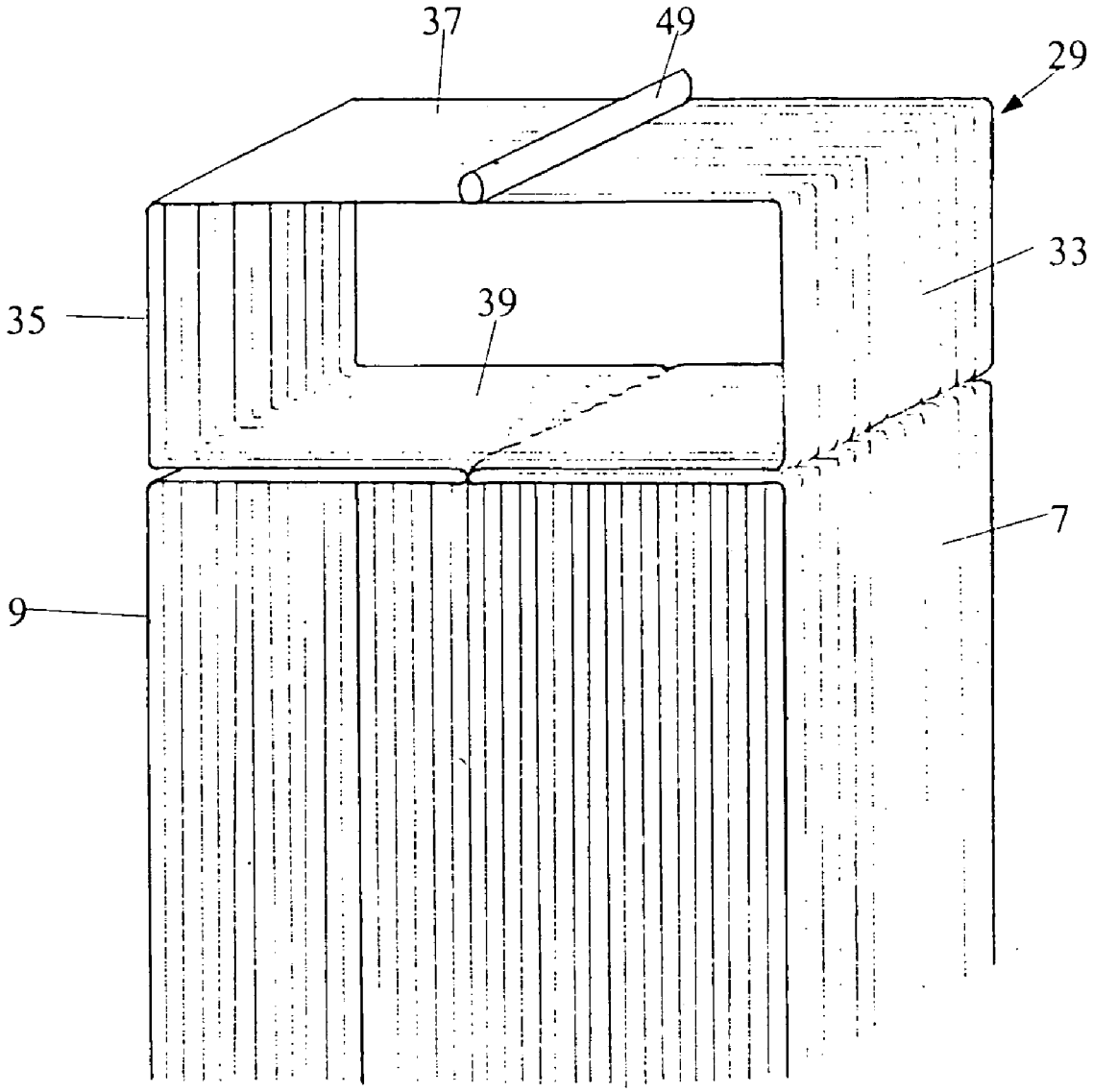
FIG. 4 is a schematic view of a preferred embodiment for forming a portion of a gas plenum.
Figure 5:
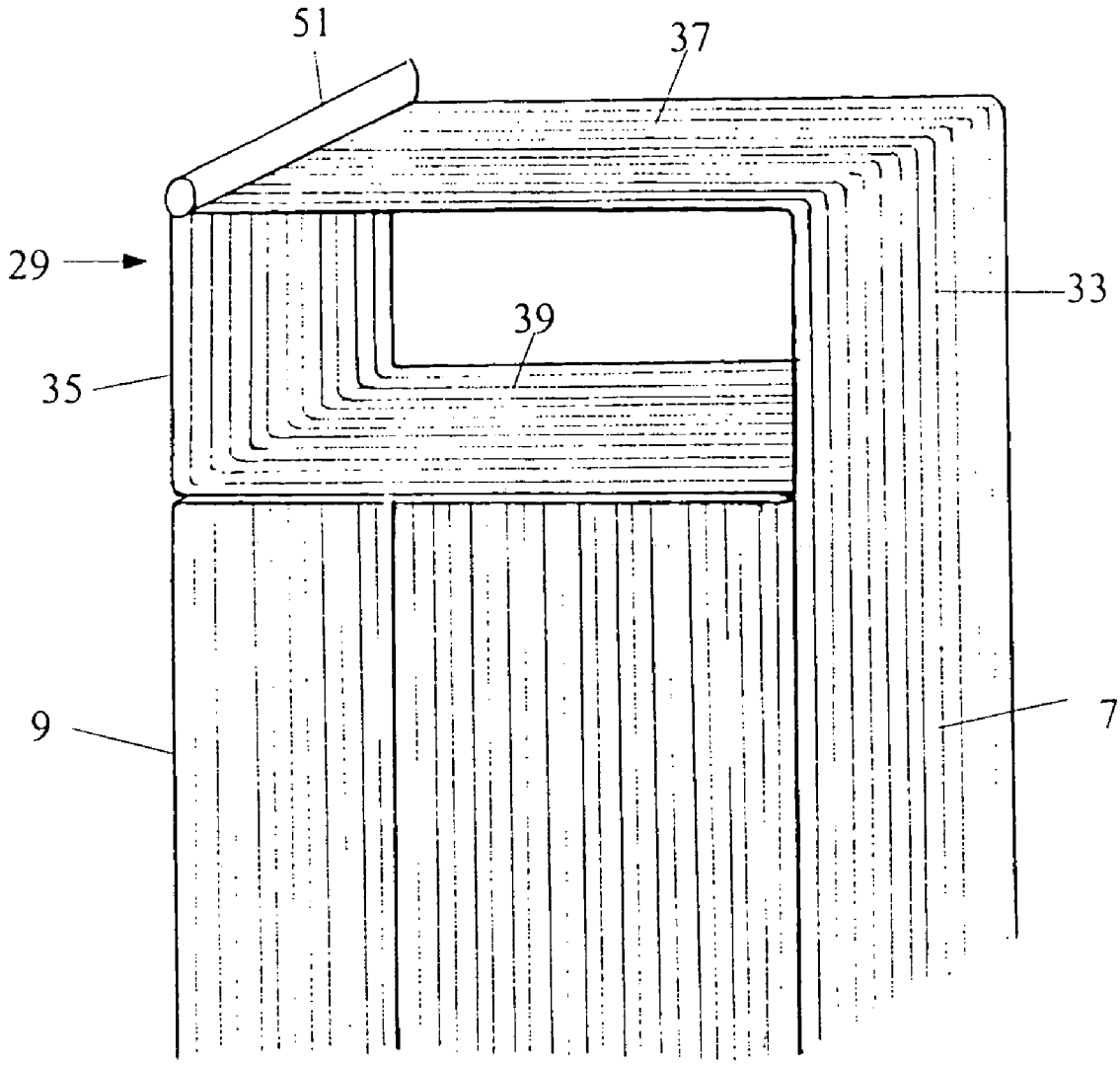
FIG. 5 is a schematic view of another preferred embodiment for forming a portion of a gas plenum.

FIGS. 4 and 5 disclose two preferred embodiments for forming a bottom 39, side walls 33, 35 and a ceiling 37 of a gas plenum 29 in a circulating fluidized bed reactor system in accordance with FIGS. 1, 2, and 3 by water tube panels. In the arrangements shown in FIGS. 4 and 5, the gas plenum 29 is provided with one chamber. The side walls 33, 35, the ceiling 37, and the bottom 39 of the gas plenum 29 are formed as extensions of the water tube panels of the side walls 7, 9 of the reaction chamber 1.

In the embodiment of FIG. 4, the extensions of the water tube panels of the side walls 7, 9 of the reaction chamber 1 are bent at the upper edges of the side walls of the reaction chamber 1 toward each other and extended in such a way that the extensions meet. At the junction point of the extensions on the ceiling 11 of the reaction chamber 1, the extensions are bent 180 degrees and extended to the lower edges of the side walls 33, 35 of the gas plenum 29, whereby they form the water tube panel, of the bottom 39 of the gas plenum 29. The water tube panels of the side walls 33, 35 are formed in such a way that the extensions forming the water tube panels of the bottom 39 of the gas plenum 29 are bent upward at the lower edges of the side walls 33, 35 of the gas plenum 29, and extended up to the upper edges of the side walls 33, 35 of the gas plenum 29. The water tube panel of the gas plenum ceiling 37 is formed in such a way that the extensions forming the water tube panels of the side walls 33, 35 are bent toward each other at the upper edges of the side walls 33, 35, extended to a header 49 arranged on the ceiling 37 of the gas plenum 29, and connected by their end edges to the header 49. The side walls 33, 35 of the gas plenum 29 are provided according to FIGS. 1 and 3 with inlet openings 41 for cleaned exhaust gases, although the inlet openings are not shown in FIG. 4.

FIG. 5 discloses an embodiment in which the extension of the water tube panel of the left side wall 9 of the reaction chamber 1 is bent at the upper edge of the left side wall 9 of the reaction chamber 1 toward the right side wall 7 of the reaction chamber 1, and extended to the right side wall 7 of the reaction chamber 1. At the right side wall 7, the extension is bent 180 degrees and extended to the lower edge of the left side wall 35 of the gas plenum 29, whereby it forms the water tube panel of the bottom 39 of the gas plenum 29. The water tube panel of the left side wall 35 of the gas plenum 29 is formed in such a way that the extension forming the water tube panel of the bottom 39 of the gas plenum 29 is bent upward from the lower edge of the left side wall 35, and extended to the upper edge of the left side wall 35. There, it is connected to a header 51. The water tube panel of the right side wall 33 of the gas plenum 29 is formed in such a way that the extension of the water tube panel of the right side wall 7 of the reaction chamber 1 is extended straight upward to the upper edge of the right side wall 33. The water tube panel of the gas plenum ceiling 37 is formed in such a way that the extension of the water tube panel forming the right side wall 33 of the gas plenum 29 is bent at the upper edge of the right side wall 33 toward the left side wall 35 of the gas plenum 29, and extended to the header 51, to which it is connected. The side walls 33, 35 of the gas plenum 29 are provided with inlet openings 41 for cleaned exhaust gases according to FIGS. 1 and 3, although the inlet openings are not shown in FIG. 5.

Figure 6:
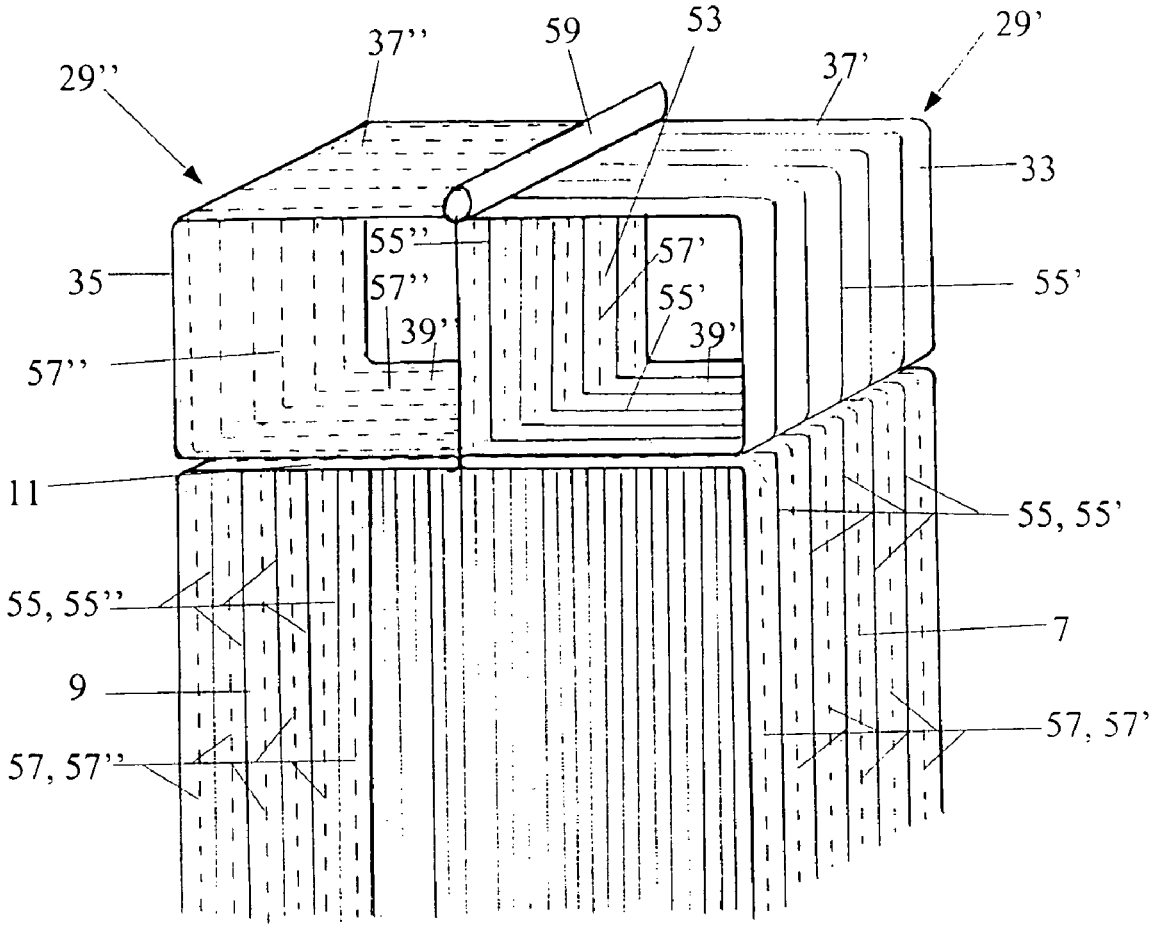
FIG. 6 is a schematic view of a preferred embodiment for forming a portion of a divided gas plenum.
Figure 7:
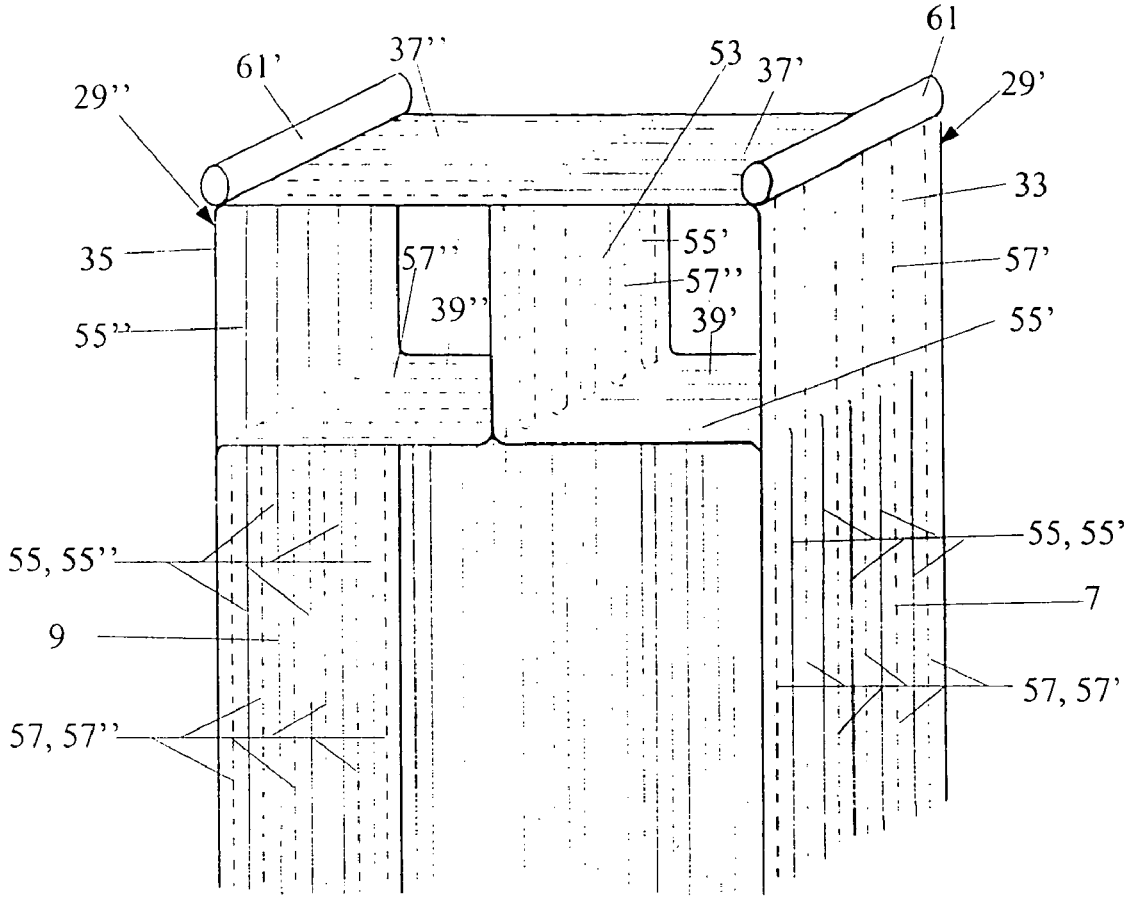
FIG. 7 is a schematic view of another preferred embodiment for forming a portion of a divided gas plenum.

FIGS. 6 and 7 disclose two preferred embodiments for forming a gas plenum 29 in a circulating fluidized bed reactor system partially by water tube panels. In these embodiments, the gas plenum 29 is divided into two separate gas plenums 29', 29" by a vertical partition 53 parallel to the side walls 33, 35 of the gas plenum. The gas plenum 29 is thereby formed of a right chamber 29' and a left chamber 29". The gas plenum 29 contains a front wall 31 (not shown), a right side wall 33, a left side wall 35, the partition 53, a right chamber bottom 39', a left chamber bottom 39", a right chamber ceiling 37', and a left chamber ceiling 37". The water tube panels of the side walls 7, 9 of the reaction chamber 1 in the embodiments in accordance with FIGS. 6 and 7 are formed of first water tubes 55 and second water tubes 57. The side walls 33, 35, the ceiling 37, the bottom 39, and the partition 53 are formed by water tube panels as extensions of the first water tubes 55 and the second water tubes 57. The tubes of thus-formed side walls 33, 35, ceiling 37, bottom 39, and partition 53 are joined to each other by fins.

In the embodiment shown in FIG. 6, the side walls 33, 35, the ceiling 37, the bottom 39, and the partition 53 of a two-chambered gas plenum 29 are formed by water tube panels as extensions of the water tube panels of the side walls 7, 9 of the reaction chamber 1. In this embodiment, the extensions of the water tube panels of the side walls 7, 9 of the reaction chamber 1 are bent at the upper edges of the side walls of the reaction chamber 1 toward each other and extended in such a way that they meet each other on the ceiling 11 of the reaction chamber 1. The water tube panel of the bottom 39' of the right chamber 29' of the gas plenum 29 is formed in such a way that the extensions of the first water tubes 55'of the water tube panel of the right side wall 7 of the reaction chamber 1 are bent 180 degrees at the point where the extensions of the water tube panels of the side walls 7, 9 of the reaction chamber 1 meet each other on the ceiling 11 of the reaction chamber 1, and are extended to the lower edge of the right side wall 33 of the gas plenum 29. Respectively, the water tube panel of the bottom 39" of the left chamber 29" of the gas plenum 29 is formed in such a way that the extensions of the second water tubes 57" of the water tube panel of the left side wall 9 of the reaction chamber 1 are bent 180 degrees at the point where the extensions of the water tube panels of the side walls 7, 9 of the reaction chamber 1 meet each other on the ceiling 11 of the reaction chamber 1, and are extended to the lower edge of the left side wall 35 of the gas plenum 29.

The water tube panel of the right wall 33 of the gas plenum 29 is formed in such a way that the extensions of the first water tubes 55' forming the bottom 39' of the right chamber 29' of the gas plenum 29 are bent upward at the lower edge of the right side wall 33 of the gas plenum 29, and extended to the upper edge of the right side wall 33 of the gas plenum 29. The water tube panel of the ceiling 37' of the right chamber 29' of the gas plenum 29 is formed in such a way that the extensions of the first water tubes 55' forming the right side wall 33 of the gas plenum 29 are bent toward the left side wall 35 of the gas plenum 29 at the upper edge of the right side wall 33, and extended to a header 59 arranged on the ceiling of the gas plenum 29. Respectively, the water tube panel of the left wall 35 of the gas plenum 29 is formed in such a way that the extensions of the second water tubes 57" forming the bottom 39" of the left chamber 29" of the gas plenum 29 are bent upward at the lower edge of the left side wall 35 of the gas plenum 29, and extended to the upper edge of the left side wall 35. The water tube panel of the ceiling 37" of the left chamber 29" of the gas plenum 29 is formed in such a way that the extensions of the second water tubes 57" forming the left side wall 35 of the gas plenum 29 are bent toward the right side wall 33 of the gas plenum at the upper edge of the left side wall 35, and extended to the header 59 arranged on the ceiling of the gas plenum 29.

The water tube panel of the partition 53 of the gas plenum 29 is formed in such a way that extensions of the second water tubes 57'of the water tube panel of the right side wall 7 of the reaction chamber 1 and extensions of the first water tubes 55" of the water tube panel of the left side wall 9 of the reaction chamber 1 are bent upward at the point where the extensions of the water tube panels of the side walls 7, 9 of the reaction chamber 1 meet on the ceiling 11 of the reaction chamber 1, and are extended to the upper edge of the partition 53, in other words, to the ceiling of the gas plenum 29. There, the extensions are connected to the header 59. The side walls 33, 35 of the gas plenum 29 are provided according to FIGS. 1 and 3 with inlet openings 41 for cleaned exhaust gas, although the inlet openings are not shown in FIG. 6.

FIG. 7 discloses another preferred embodiment, in which the side walls 33, 35, the ceiling 37, the bottom 39, and the partition 53 of the gas plenum 29 are formed by water tube panels as extensions of the water tube panels of the side walls 7, 9 of the reaction chamber 1. In this embodiment, the water tube panel of the bottom 39' of the right chamber 29' of the gas plenum 29 is formed in such a way that extensions of the first water tubes 55' of the water tube panel of the right side wall 7 of the reaction chamber 1 are bent at the upper edge of the right side wall 7 of the reaction chamber 1 toward the left side wall 9 of the reaction chamber 1, and extended to the lower edge of the partition 53. Respectively, the water tube panel of the bottom 39" of the left chamber 29" of the gas plenum 29 is formed in such a way that extensions of the second water tubes 57" of the water tube panel of the left side wall 9 of the reaction chamber are bent at the upper edge of the left side wall 9 of the reaction chamber 1 toward the right side wall 7 of the reaction chamber 1, and extended to the lower edge of the partition 53. The water tube panel of the partition 53 is formed in such a way that the extensions of the first water tubes 55' and the extensions of the second water tubes 57", respectively forming bottoms 39' and 39" of the chambers 29' and 29" of the gas plenum 29, are bent at the lower edge of the partition 53 upward, and extended to the upper edge of the partition 53, in other words, to the ceiling of the gas plenum 29.

The water tube panel of the ceiling 37' of the right chamber 29' of the gas plenum 29 is formed in such a way that the extensions of the first water tubes 55' forming the partition 53 are bent at the upper edge of the partition toward the right side wall 33 of the gas plenum 29 and extended to the upper edge of the right side wall 33 of the gas plenum 29, where they are joined to a header 61. Respectively, the water tube panel of the ceiling 37" of the left chamber 29" of the gas plenum 29 is formed in such a way that the extensions of the second water tubes 57" forming the partition 53 are bent at the upper edge of the partition toward the left side wall 35 of the gas plenum 29 and extended to the upper edge of the left side wall 35 of the gas plenum 29, where they are joined to a header 61'.

The water tube panel of the right side wall 33 of the gas plenum 29 is formed in such a way that extensions of the second water tubes 57' of the water tube panel of the right side wall 7 of the reaction chamber 1 are extended at the upper edge of the right side wall 7 of the reaction chamber 1 directly upward to the upper edge of the right side wall 33 of the gas plenum 29, where they are joined to the header 61. Respectively, the water tube panel of the left side wall 35 of the gas plenum 29 is formed in such a way that extensions of the first water tubes 55" of the water tube panel of the left side wall 9 of the reaction chamber 1 are extended at the upper edge of the left side wall 9 of the reaction chamber 1 directly upward to the upper edge of the left side wall 35 of the gas plenum 29, where they are joined to the header 61'. The side walls 33, 35 of the gas plenum 29 are provided with inlet openings 41 for cleaned exhaust gas according to FIGS. 1 and 3, although the inlet openings are not shown in FIG. 7.

Since, in the embodiments in accordance with FIGS. 6 and 7, the extensions of the first water tubes 55' of the water tube panel of the right side wall 7 of the reaction chamber 1 and the extensions of the second water tubes 57" of the water tube panel of the left side wall 9 of the reaction chamber 1 are joined in the partition 53, it is possible to provide a rigid and durable structure without separate supports.

In the embodiment in accordance with FIG. 7, the water tubes of the water tube panels of the side walls 33, 35 of the gas plenum 29 and the water tubes of the water tube panels of the bottom 39', 39" and of the ceiling 37', 37" of the gas plenum 29 may have a diameter greater than that of the water tubes of the water tube panels of the side walls 7, 9 in the reaction chamber 1. Respectively, in the embodiment in accordance with FIG. 6, the diameters of the water tubes of the bottom 39', 39" ceiling 37', 37" and side walls 33, 35 of the gas plenum 29 may be greater than those of the water tubes of the water tube panels of the side walls 7, 9 of the reaction chamber 1. Excessively wide fins between the tubes and excess increase of temperature of the fins are thereby avoided. At the same time, the structure of the panels is reinforced.

Figure 8:
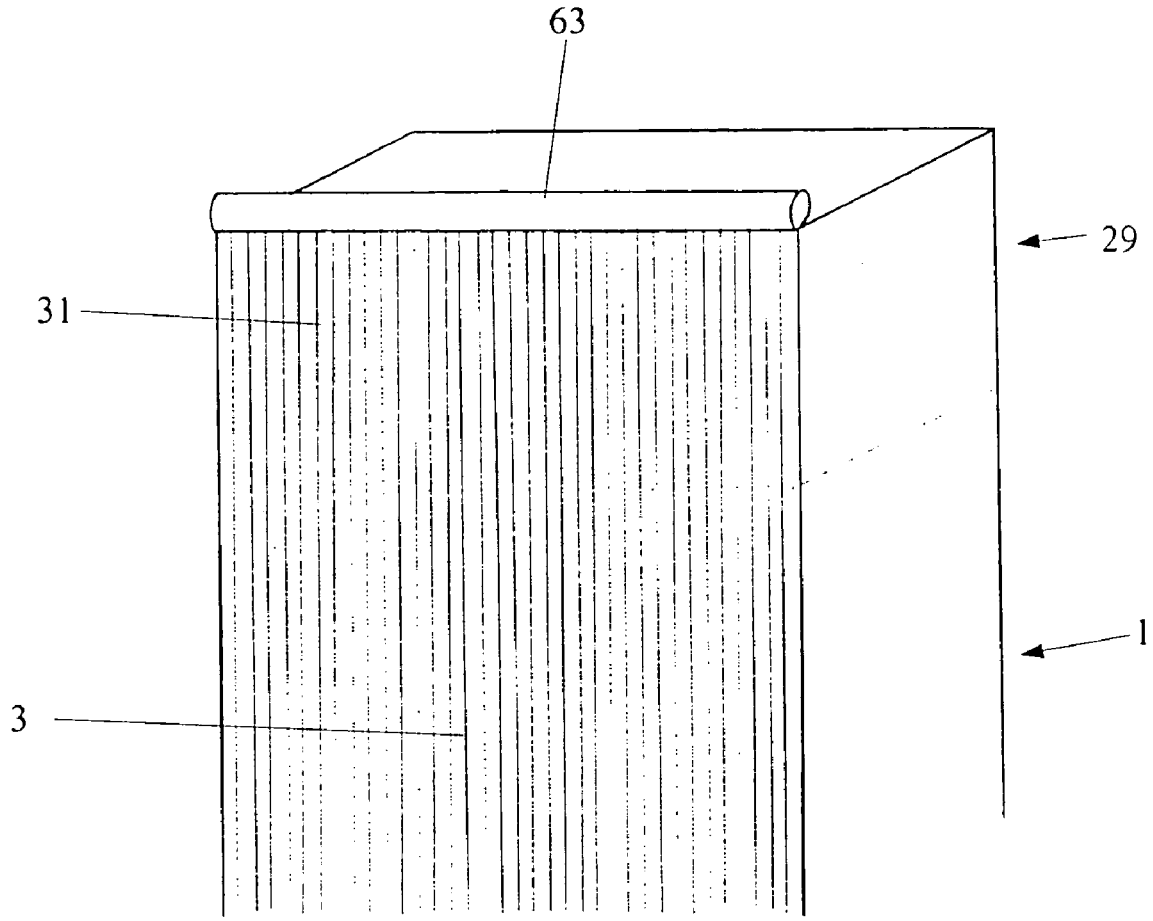
FIG. 8 is a schematic view of a preferred embodiment for forming a front wall of a gas plenum.
Figure 9:
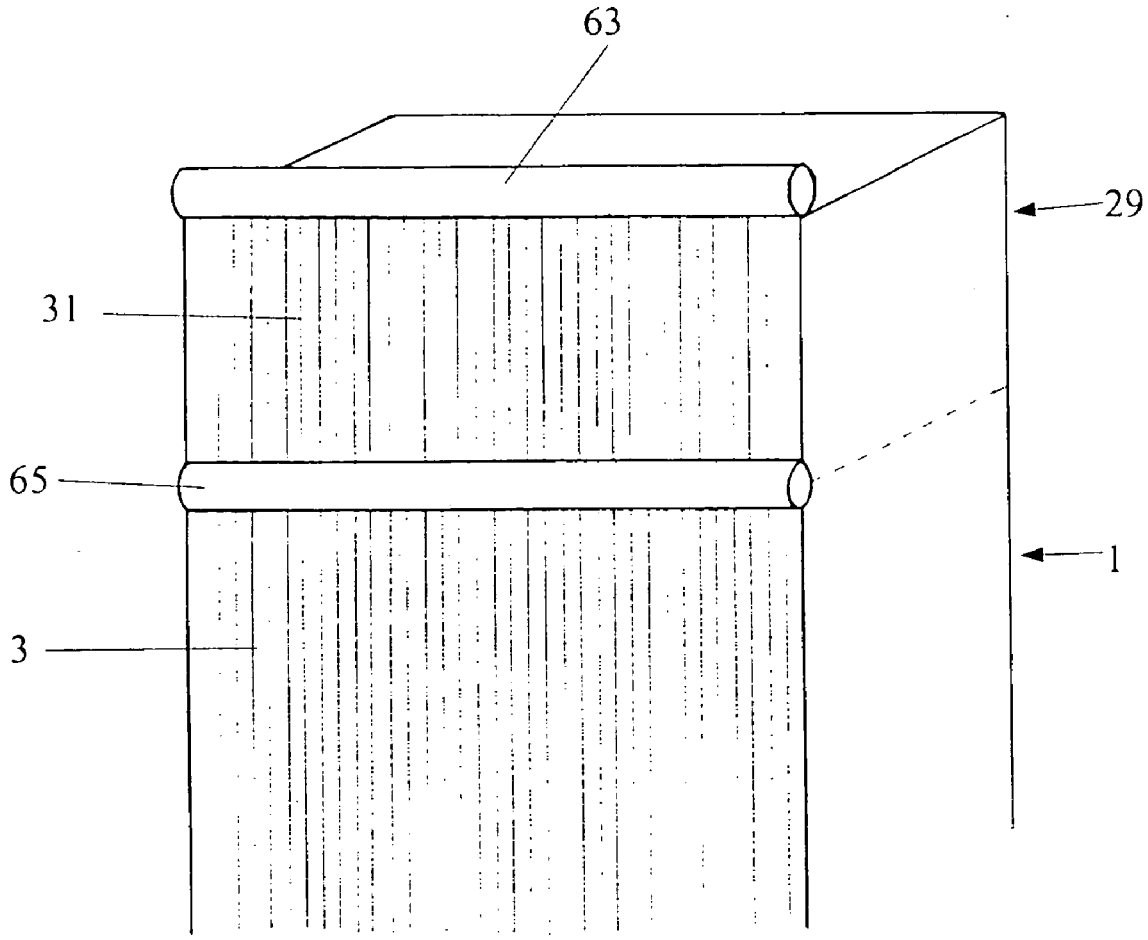
FIG. 9 is a schematic view of another preferred embodiment for forming a front wall of a gas plenum.

FIGS. 8 and 9 disclose two preferred embodiments according to the invention for forming the front wall 31 of the gas plenum 29 in a circulating fluidized bed reactor system according to FIGS. 1 and 3 with water tube panels as an extension of the water tube panel of the front wall 3 of the reaction chamber 1.

In the embodiment in accordance with FIG. 8, the front wall 31 of the gas plenum 29 is formed by water tube panels simply by extending the water tube panel of the front wall 3 of the reaction chamber 1 to the upper edge of the front wall 31 of the gas plenum 29, where it is joined to a header 63.

In the embodiment in accordance with FIG. 9, the water tube panel of the front wall 31 is formed in such a way that a header 65 is located at the upper edge of the front wall 3 of the reaction chamber 1, to which header 65 the water tube panel of the front wall 3 of the reaction chamber 1 is connected, and from which header 65 it is extended to the upper edge of the front wall 31 of the gas plenum 29, where it is connected to another header 63. The advantage thereof is that by arranging the header 65 at the upper edge of the front wall 3 of the reaction chamber 1 as well, it is possible to distribute the heat transfer medium more evenly to the tubes of the water tube panel of the front wall 31 of the gas plenum 29.

In the embodiment of FIGS. 1, 2, and 3 in accordance with the invention, there are six particle separators arranged in such a way that both the side walls of the reaction chamber 1 are each provided with three particle separators. The number of particle separators may be different from six. The particle separators may also all be mounted on one of the side walls. The particle separators may be arranged also or only on the front wall 3 of the reaction chamber 1. Furthermore, the particle separators can be arranged in different numbers on different walls. Generally speaking, particle separators can be freely located around the reaction chambers. A gas plenum 29 according to the invention can be used to combine the cleaned exhaust gas from any number and configuration of particle separators.

Although both the reaction chamber 1 and the gas plenum 29 in the embodiments shown in the drawings are disclosed as rectangular in horizontal cross section, they may be of other polygonal shapes in horizontal cross section as well, such as hexagons or octagons.

Although the gas plenum 29 in the embodiments of the drawings is disclosed as having one or two chambers, it may also be, in some situations, multichambered. Although the chambers of the gas plenum 29 have been illustrated as being arranged adjacently, they may, in some special cases, be arranged one on top of the other, as well.

Further, although the gas plenum 29 in the disclosed examples of the drawings has been divided into separate chambers with a vertical partition parallel to the side walls of the chambers, the partition can in some cases be somewhat diagonal or inclined.

Although in the embodiment in accordance with FIGS. 1, 2 and 3, the discharge ducts of all of the particle separators are connected to the gas plenum 29, some of the discharge ducts can advantageously be connected directly to the connecting channel 45 between the gas plenum 29 and the heat recovery section 47. By connecting some of the discharge ducts of the particle separators directly to the connecting channel 45 downstream of the gas plenum 29, the height of the gas plenum 29 can be diminished. The minimum height of the gas plenum 29 may be defined, for example, in such a way that the flow speed of the cleaned exhaust gas does not exceed a certain maximum value. This is clearly exemplified at a point where screen tubes 67 (FIG. 3) are located.

FIG. 3 shows the connecting channel 45 widening in the flow direction of the cleaned exhaust gases. The connecting channel 45 does not necessarily have to widen as shown in FIG. 3. However, if discharge ducts of one or more of the particle separators are directly connected to the connecting channel, it is preferable that the connecting channel widens.

Furthermore, although FIGS. 8 and 9 disclose some preferred embodiments for forming the front wall 31 of the gas plenum 29 in the circulating fluidized bed reactor system in accordance with FIG. 1 as an extension of the water tube panel of the front wall 3 of the reaction chamber 1, other walls may be similarly formed. Moreover, it is possible, in the embodiments in accordance with FIGS. 4 to 7, to arrange headers, for example, at the upper edges of the side walls of the reaction chamber 1, if one wishes to distribute the heat transfer medium more evenly to the tubes of the water tube panels forming the gas plenum 29, i.e., the extensions of the water tube panels of the reaction chamber walls.

By utilizing the embodiments disclosed in the drawings, it is possible to form the gas plenum entirely out of water tube panels as extensions of the water tube panels of the reaction chamber walls. It is also possible to have the water tube panels of the gas plenum 29 be either completely or partially refractory-lined, if the temperature of the cleaned exhaust gas decreases too much before the gas reaches the heat recovery section.

By utilizing the arrangement in accordance with the invention, the use of refractory-lined exhaust gas ducts and the problems associated with ducts, such as a need for maintenance due to embrittlement and wearing of the ducts, are minimized. Additionally, costs associated with refractory-lined ducts, such as building and maintenance costs, are minimized as well.

Since the arrangement in accordance with the invention discloses a gas plenum integrated with a reaction chamber, the need for excessive additional support is eliminated. Moreover, owing to the rigid construction, problems caused by vibration between risers, additional supports—which the arrangement in accordance with the invention does not require—and channels are avoided.

Additionally, in the arrangement in accordance with the invention, discharge ducts of all particle separators are equally long and end at the same space, i.e., the gas plenum, in other words, at the same pressure. As a result, uneven distribution of exhaust gases between the particle separators and associated operational problems are avoided in the circulating fluidized bed reactor system.

While the invention has been described herein by way of examples in connection with what are at present considered to be the most preferred embodiments, it is to be understood that the invention is not limited to the disclosed embodiments, but is intended to cover various combinations or modifications of its features and several other applications included within the scope of the invention as defined in the appended claims.

I claim:

1. An arrangement in a circulating fluidized bed reactor system, the arrangement comprising:

a reaction chamber, having a fluidized bed of solid particles therein, and being defined by a ceiling, a bottom, and walls, which are at least partially formed by water tube panels;

means for introducing fluidizing gas into said reaction chamber;

at least two discharge openings arranged in the walls of said reaction chamber for removing a particle suspension of exhaust gases and solid particles from said reaction chamber;

at least two particle separators connected to said discharge openings, for separating the solid particles from the particle suspension, each of said particle separators having a gas discharge opening in an upper part thereof, for discharge of cleaned exhaust gases, each of the gas discharge openings being connected to a discharge duct;

a heat recovery section, to which the cleaned exhaust gases are directed; and a gas plenum, defined by an enclosure comprising a ceiling, a bottom, and walls positioned above and integrated with said reaction chamber, for directing the cleaned exhaust gases discharged from said at least two particle separators to said heat recovery section, said gas plenum being provided with at least two exhaust gas inlet openings arranged in the walls thereof for receiving the cleaned exhaust gases from the discharge ducts of said at least two particle separators and directing the cleaned exhaust gases to said gas plenum, said gas plenum also being connected to a connecting channel downstream of said gas plenum for leading the cleaned exhaust gases from said gas plenum to said heat recovery section, wherein the enclosure of said gas plenum is formed by water tube panels as extensions of the water tube panels of said reaction chamber, and said gas plenum is divided into at least two separate chambers by at least one partition that is formed by at least one water tube panel as an extension of at least one of the water tube panels of said reaction chamber.

2. An arrangement in accordance with claim 1, wherein the water tube panel that forms a first one of the walls of said reaction chamber comprises first and second water tubes, at least a portion of the water tube panel that forms the bottom of the enclosure of said gas plenum is formed as an extension of the first water tubes of the water tube panel that forms the first wall of said reaction chamber, and at least a portion of the water tube panel that forms one of the walls of the enclosure of said gas plenum is formed as an extension of the second water tubes of the water tube panel that forms the first wall of said reaction chamber.

3. An arrangement in accordance with claim 2, wherein at least a portion of the water tube panel that forms the partition of said gas plenum is formed as an extension of the first water tubes of the water tube panel that forms the first wall of said reaction chamber.

4. An arrangement in accordance with claim 1, wherein the water tube panel that forms a first one of the walls of said reaction chamber comprises first and second water tubes, at least a portion of the water tube panel that forms the bottom of the enclosure of said gas plenum is formed as an extension of the first water tubes of the water tube panel that forms the first wall of said reaction chamber, at least a portion of the water tube panel that forms one of the walls of the enclosure of said gas plenum is formed as an extension of the first water tubes of the water tube panel that forms the first wall of said reaction chamber, and at least a portion of the water tube panel that forms the partition of said gas plenum is formed as an extension of the second water tubes of the water tube panel that forms the first wall of said reaction chamber.

5. An arrangement in accordance with claim 1, wherein the water tube panels that form the enclosure of said gas plenum comprise water tubes and the enclosure of said gas plenum is at least partially formed as an extension of the water tube panel that forms one of the walls of said reaction chamber in such a way that a portion of the water tubes of the water tube panel that forms the wall of said reaction chamber is connected at the upper edge of the walls of said reaction chamber to a header, from which header the water tubes are extended to form a portion of the enclosure of said gas plenum.

6. An arrangement in accordance with claim 1, wherein there are at least three particle separators, and the discharge duct of at least one of the particle separators is connected directly to the connecting channel downstream of said gas plenum.

7. An arrangement in accordance with claim 6, wherein the connecting channel widens in the flow direction of the cleaned exhaust gases.

* * * * *